US005875654A

United States Patent [19]

Mista et al.

[11] Patent Number: 5,875,654

[45] Date of Patent: Mar. 2, 1999

[54] ARRANGEMENT FOR CONTROLLING THE STROKE OF STROKE ELEMENTS IN A WARP KNITTING MACHINE

[75] Inventors: Kresimir Mista, Heusenstamm; Joachim Fischer, Rodgau, both of Germany

[73] Assignee: Karl Mayer Textilmachinenfabrik GmbH, Obertshausen, Germany

[21] Appl. No.: 985,645

[22] Filed: Dec. 5, 1997

[30] Foreign Application Priority Data

Dec. 24, 1996 [DE] Germany ..... 196 54 327.4

[51] Int. Cl.[6] ..... D04B 27/24; D04B 27/32

[52] U.S. Cl. ..... 66/205; 66/214

[58] Field of Search ..... 66/205, 214; 139/453, 139/455

[56] References Cited

U.S. PATENT DOCUMENTS 5,533,366 7/1996 Mista et al. ..... 66/205

5,669,248 9/1997 Mista et al. ..... 66/205

FOREIGN PATENT DOCUMENTS 2012734 9/1970 Germany ..... 66/205

1951499 5/1996 Germany .

*Primary Examiner*—Andy Falik

*Attorney, Agent, or Firm*—Omri M. Behr, Esq.

[57] ABSTRACT

A stroke control arrangement (1) for influencing individual threads of a thread sheet, in particular for a warp knitting machine, comprises entrainment devices (20) controllable by piezoelectric transducers (19). The entrainment devices (20) are provided adjacent to the transducers (19) in the transverse direction and are born at one end thereof in a portion (25) supported by a carrier (16) and carry at the other end thereof a transport stop (37). The transport stop (37) in a first position carries a stroke element, which in a second position of the transport stop (37), to the contrary, is left uninfluenced. In this way there is obtained a reliable system for stroke control.

32 Claims, 4 Drawing Sheets

ARRANGEMENT FOR CONTROLLING THE STROKE OF STROKE ELEMENTS IN A WARP KNITTING MACHINE

BACKGROUND OF THE INVENTION

1. Field of the Invention

The present invention relates to a control arrangement for influencing individual threads in a thread sheet, in particular, for warp knitting machines comprising a bar extending in the longitudinal direction having provided therein, stroke elements moveable in the stroke direction and a carrier extending in the longitudinal direction driveable to and fro in the stroke direction which is provided with adjacently ordered piezoelectric transducers. One end of said transducers being connected to the carrier and the other, free end, in dependence upon electrical control signals will either take up a first position, or a second position displaced in the longitudinal direction. The arrangement further comprises entrainment means which are connected to the free end of the transducers. The entrainment means (a) in the first position can move appropriate stroke elements in the stroke direction by contacting a counterstop of the stroke element, and (b) in the second position can leave the stroke element uninfluenced.

2. Description of Related Art

In a known stroke control arrangement of this type (DE 195 14 995 A1, FIGS. 8 through 11) the strip-formed piezoelectric transducers are provided as extensions of the corresponding stroke elements. The entrainment means are attached to flanges attached to and extending beyond both sides of the free ends of the transducers which, in the first position work together with a front facing step of the stroke element and in the second position are so bent that they lie next to the appropriate stroke element, wherein the transducer enters into an aperture in the stroke element. Since the transducers are attached to the carrier and are constantly moved backwards and forwards therewith, it is not necessary to provide sensitive pawls controlled by fixed transducers to the stroke elements (DE 195 14 995 A1, FIGS. 1 through 7). However, certain deficiencies in the transducers must be taken into account.

A purpose of the present invention is to provide a stroke control arrangement of the sort described hereinabove which better addresses the requirements of the art.

This task is preferably served thereby that the entrainment means are provided in the transverse direction adjacent to the transducers and at one end thereof are supported in a construction unit rigidly affixed to the carrier and whose other end carries the entrainment means.

SUMMARY OF THE INVENTION

In accordance with the illustrative embodiments demonstrating features and advantages of the present invention, there is provided a stroke control arrangement for influencing individual threads of a thread sheet for a warp knitting machine. The stroke control arrangement includes a longitudinally extending bar, and a plurality of guided stroke elements. Each of the stroke elements has a counterstop and each is mounted on the longitudinally extending bar in a stroke direction. Also included is a carrier extending longitudinally and adapted to reciprocate in the stroke direction, as well as a plurality of piezoelectric transducers mounted in a row at the carrier. Each of the transducers is responsive to an electrical control signal and each has a restrained end connected to the carrier. Each of the transducers also has a free end moveable, in dependence upon the electrical control signal, between a first position and a longitudinally displaced second position. The stroke control arrangement also has a plurality of entrainment means transversely mounted adjacent to the transducers. Each of the entrainment means has one end with a stop and another end supported on a portion of the carrier. Each of the entrainment means is coupled to the free end of a corresponding one of the transducers and is operable (a) in a first position to affect engagement between the stop of the entrainment means and the counterstop of the stroke element, in order to carry the corresponding one of the stroke elements in the stroke direction, and (b) in a second position to refrain from affecting the stroke elements.

In this construction the entrainment forces may be transmitted to the stroke element via the entrainment means. The transducers remain uninfluenced thereby. This increases their working life and the switch security quite considerably. The entrainment means can have a sufficient stability and can be displaced by small forces by the transducers. Friction can be kept at a minimum by the use of low friction materials and by swing path limiting stops, which again increases the operative life.

It is advantageous generally to make the entrainment means from flat sheet metal. Thus, the entrainment means can be arranged rather close to each other.

It is advantageous to provide that the entrainment means are connected with the free ends of the appropriate transducers via sidewardly extending arms. The entrainment means and the transducers can thus lie in a common plane.

Advantageously, the entrainment means with the sideward arms may interact with the opposed protrusions in the apertures which limit the swing path. Both positions of the entrainment means are thus clearly defined.

It is further advantageous if the transducers are set back in the stroke direction, relative to the entrainment means. Thus, the size of the swing path of the entrainment means is increased with respect to the swing path of the transducers. Rather small deflections of the transducers will then be sufficient to displace a entrainment means from one position to the other.

It is advantageous to provide of one end the entrainment means with an axle on which it is rotatable. The entrainment means thus provide levers which are readily rotatable.

A similarly preferred alternative resides wherein, the stroke elements are supported in a groove whose side walls converge somewhat inwardly. Since the entrainment means, through their combination with the transducers are held in the grooves, even here there is provided an easy rotatability.

It is further advantageous if the supporting area is formed of a material with better support qualities than the carrier. This insert can tolerate relatively high entrainment forces, which again increases the operative life.

It is desirable in some embodiments, that at the free ends of the transducers, carry a front facing end piece provided with a slit which has the same thickness and breadth as the adjacent portion as the transducer, and that sideward arms grip into the slot. Such transducers may be readily mass produced and integrated. The dimensions of the end section thus do not exceed those of the corresponding transducer.

It is advantageous for the entrainment means to be provided with a return stop which, through contact with a return counterstop of the corresponding stroke element, returns it in the stroke direction. Such a return stop forces the stroke element back into the initial position. An operating interference due to the collision of the stroke elements and other knitting elements is therefore excluded.

In a preferred embodiment, it is provided that the entrainment means in the first position are located flat against the appropriate stroke elements and have a stop-forming flange between the front facing edge and an aperture, and that the stroke element carries counterstops extending from both sides of the flange in its plane. This type of coupling permits close grouping of the stroke elements.

In particular, the counterstops can be formed from a tongue pressed out of the stroke element and/or from a plate set thereon.

Further, the plate can overlie the stroke element in the transverse direction and grip into a guide groove. The plate therefore has a double function.

In a similarly preferred embodiment it is provided that the entrainment means in the first setting are provided as extensions of the appropriate stroke elements and that the stops and counterstops are formed by the edges of the entrainment means and the stroke elements. This permits a particularly compact arrangement, wherein 16 stroke elements per inch can be provided.

Herein, it is advantageous that in the first position an extension of one element grasps into an aperture in the other element, wherein the flange segments extending in the transverse direction overlap each other.

In a further embodiment of the invention, guide sheets are connected with a part rigidly affixed to the carrier, which occupy the space between the entrainment means and the stroke element. These guides facilitate exact operation of the system.

Furthermore, it is advantageous to provide that the stroke elements are located between a guide sheet and a guide lamella attached to the adjacent guide sheet. In this way, the stroke elements have a definite positioning.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
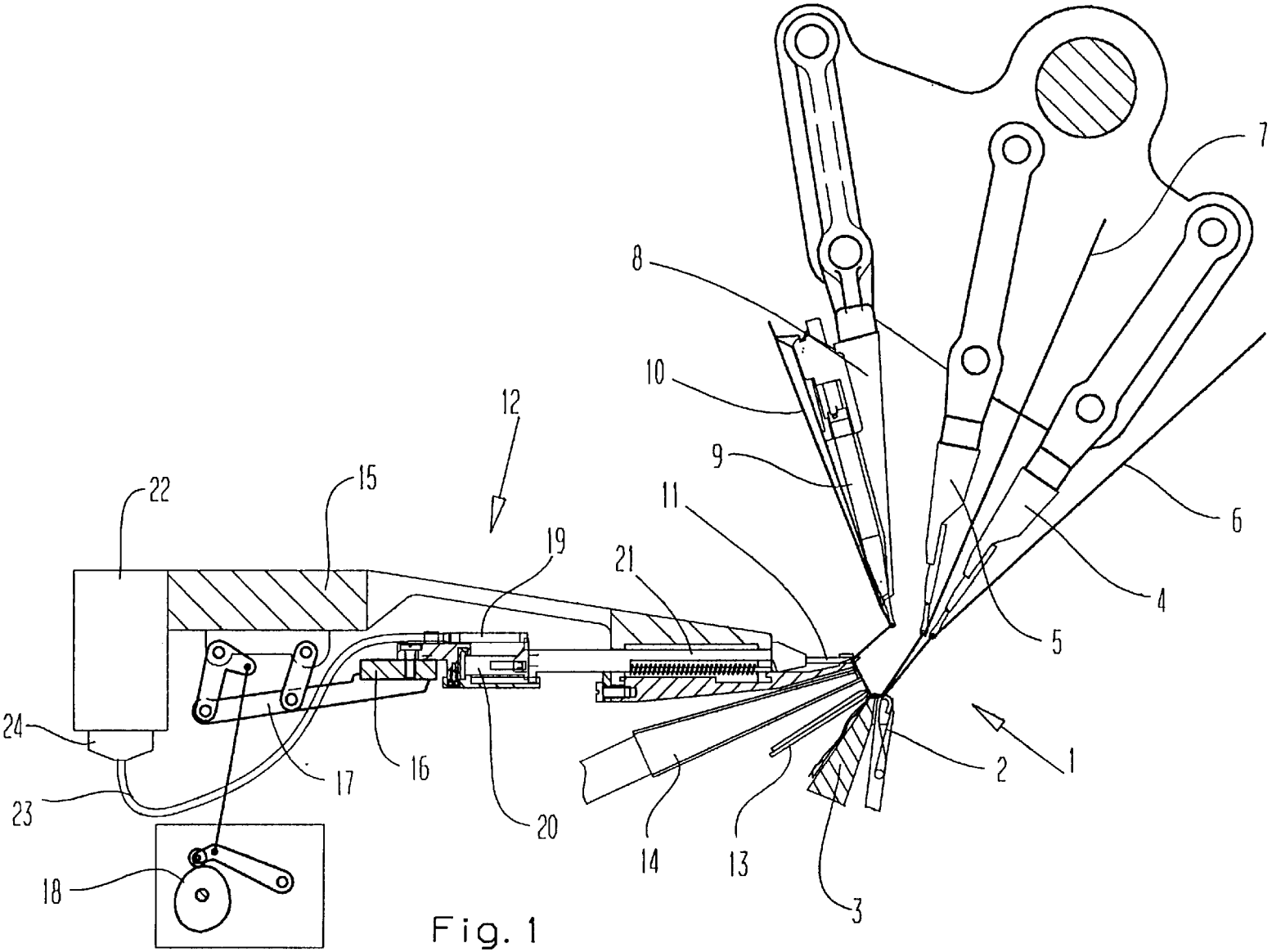
FIG. 1 is a partial, cross-sectional, elevational view of the working area of a warp knitting machine.

A warp knitting machine in accordance with FIGS. 1 through 4 and 6, comprises a working area (1) in which the needle bed (2) is near a knock-over bar (3). There are provided two guides bars (4) and (5) which serve to create ground fabric from threads (6) and (7). A further guide bar (8), equipped with a jacquard arrangement (9), provides pattern threads (10) which, by means of needles (11) of a stroke control arrangement (12) can, in accordance with the pattern, be grasped and held and then be cut-off by means of a cutting knife (13). There is further provided for this purpose a suction jet (14) which removes the cut-off segment of the pattern thread (10).

The stroke control arrangement (12) comprises a longitudinally extending bar (15) in which a carrier (16) is driven to and fro by a rod (17) acting with a cam plate (18). To the carrier (16) are provided piezoelectric transducers (19), entrainment means (20), and stroke elements (21), which will be considered in detail hereinbelow. The transducers (19) are served by an electrical control arrangement (22) via conduit bundle (23) and a 17-poled plug (24).

Figure 2:
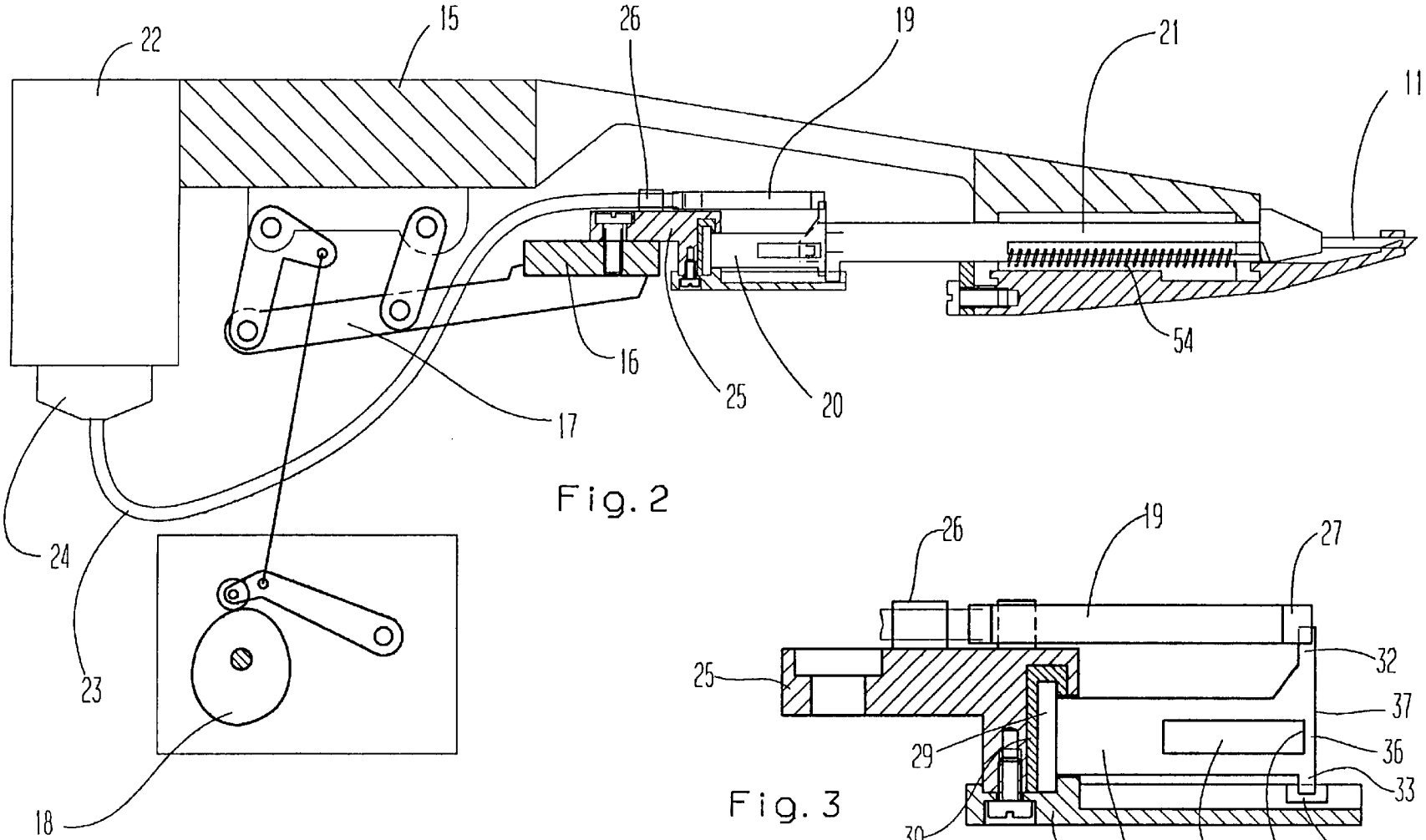
FIG. 2 is a side, elevational, cross-sectional view of the entire stroke arrangement of FIG. 1.
Figure 3:
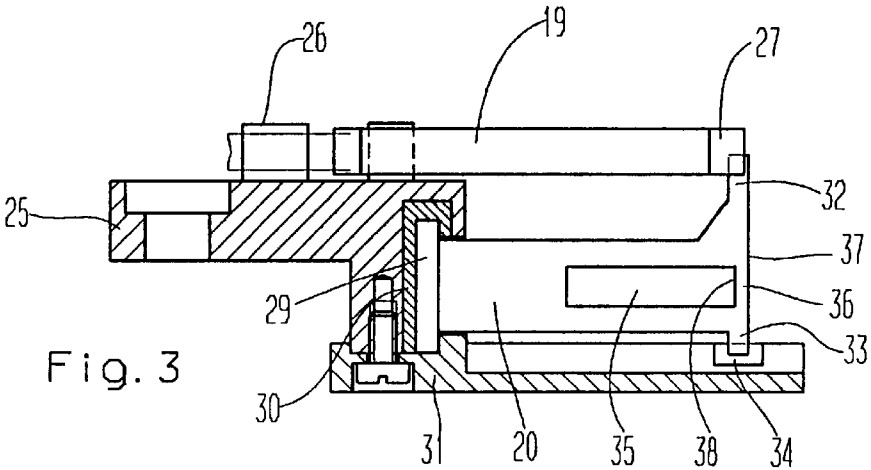
FIG. 3 is a detailed illustration of a portion of the arrangement of FIG. 3.

The to and fro driveable carrier (16) comprises removable segments (25) (see e.g., FIGS. 2 and 3). These carry a comb (26) which takes up one end of the 16 piezoelectric transducers (19). These transducers are constructed, as usual, of a strip of insulating material on each side of which, is provided a working electrode, a piezoelectric layer, and on the outside, a ground electrode. When the working electrode is provided, for a short time, with potential, the free end of transducer (19) takes up a first position. When the other electrode is provided with potential for a short time, the free end of the transducer (19) takes up a second position. The free end carries an end portion (27) which is provided with a slot (28) (FIG. 6) which corresponds to the breadth and thickness of the strip-formed transducer (19).

The entrainment means (20), which are made of sheet metal, are provided at one end with a bearing peg (29) protruding from both sides thereof which is supported in an insert (30) (FIG. 3) in segment (25). This insert is made of a material of better support qualities then segment (25). A lid (31) serving as a guide element, closes off the support area.

The entrainment means (20) comprises a sidewardly extending arm (32) which grips into slot (28) of end piece (27). On the opposite side, a protrusion (33) grips into pocket formed opening (34). The mutually opposite end surfaces of the pocket serve as stops to exactly position the entrainment means (20) in the first or second position. Entrainment means (20) has a rectangular aperture (35) so positioned that a stop member (flange 36) remains, whose outer edge comprises an entrainment means stop (37) and whose opposite edge forms the return stop (38).

Figure 4:
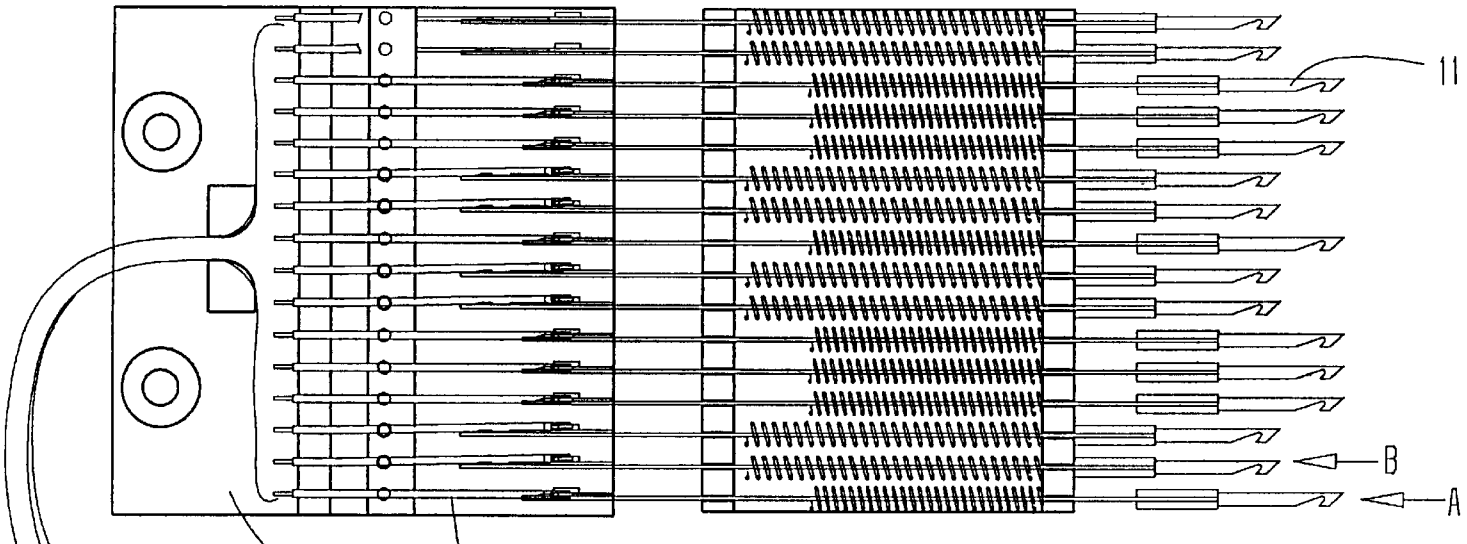
FIG. 4 is a plan view of a portion of the stroke control arrangement of FIG. 1.
Figure 6:
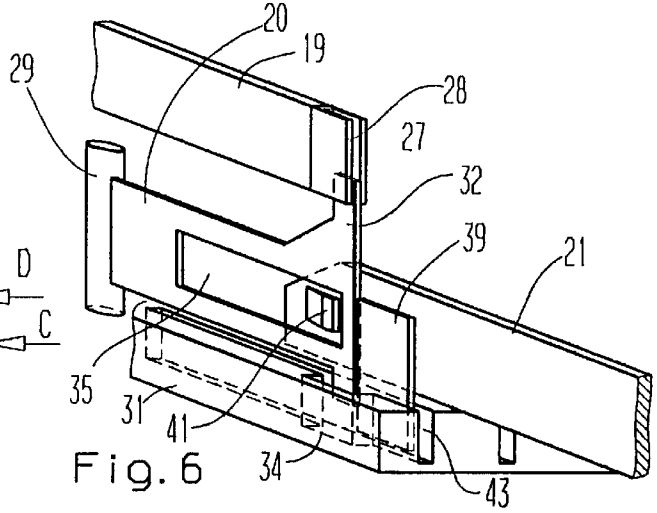
FIG. 6 is a perspective view of the relationship between the transducers, the entrainment means and the stroke element of FIGS. 1–5.

The stroke elements (21), which are also made of sheet metal, carry the hook needles (11) and are biased by compression springs (54). By means of the entrainment means stop (37) they move in working position A (FIG. 4) and, by means of the return stop (38) and the compression spring (54) are returned into the at rest position B. On one side they carry a plate (39) whose edge, in the first position C (FIGS. 5 and 6) of the entrainment means (20) works together with the entrainment means stop (37) as an entrainment means counterstop (40), so that at the entrainment of carrier (16) the appropriate stroke element (21) can be carried along into working position A (FIG. 4).

Furthermore, stroke element (21) carries a return counterstop (42) on a pressed out tongue (41), which in the first position C of the entrainment means (20) enters into a connection with the return stop (38) so that stroke element (21) is forced to move out of the working position A when carrier (16) moves itself backward. When, per contra, the entrainment means (20) takes up the second position D, both of the stops (37) and (38) are located outside the travel path of the counterstops (40) and (42). In this case the appropriate stroke element (21) is not transported, but stays in its at rest position B. The plate (39) is located sidewards over the stroke element (21) and grips into a groove (43) which guides the stroke element relative to segment (25).

Figure 5:
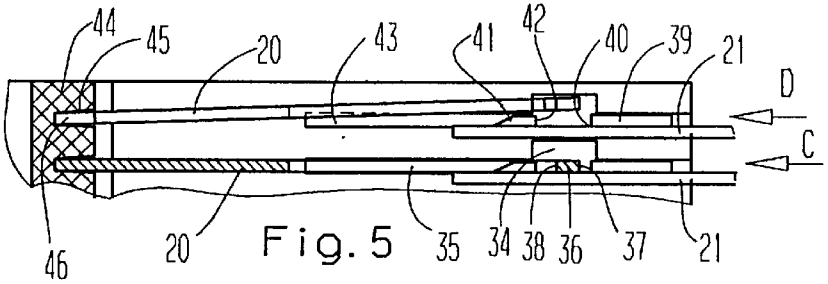
FIG. 5 is a partial, cross-sectional view showing the interaction between the entrainment means and the stroke element of FIG. 4.

FIG. 5 is, in the upper half, a plan view and in the lower half a cross-sectional cut through the entrainment means (20). It is illustrated as an embodiment wherein, for the support of the entrainment means (20) there is provided an insert (44) of a material having good supporting qualities, set in a groove (45) having tapered walls with a mild V form relative to each other. In this situation, it is only necessary for end (46) of entrainment means (20) whose pegs (29) protrude somewhat, on both sides, to be set into the groove. The lid (31) prevents the entrainment means (20) from falling out.

Figure 7:
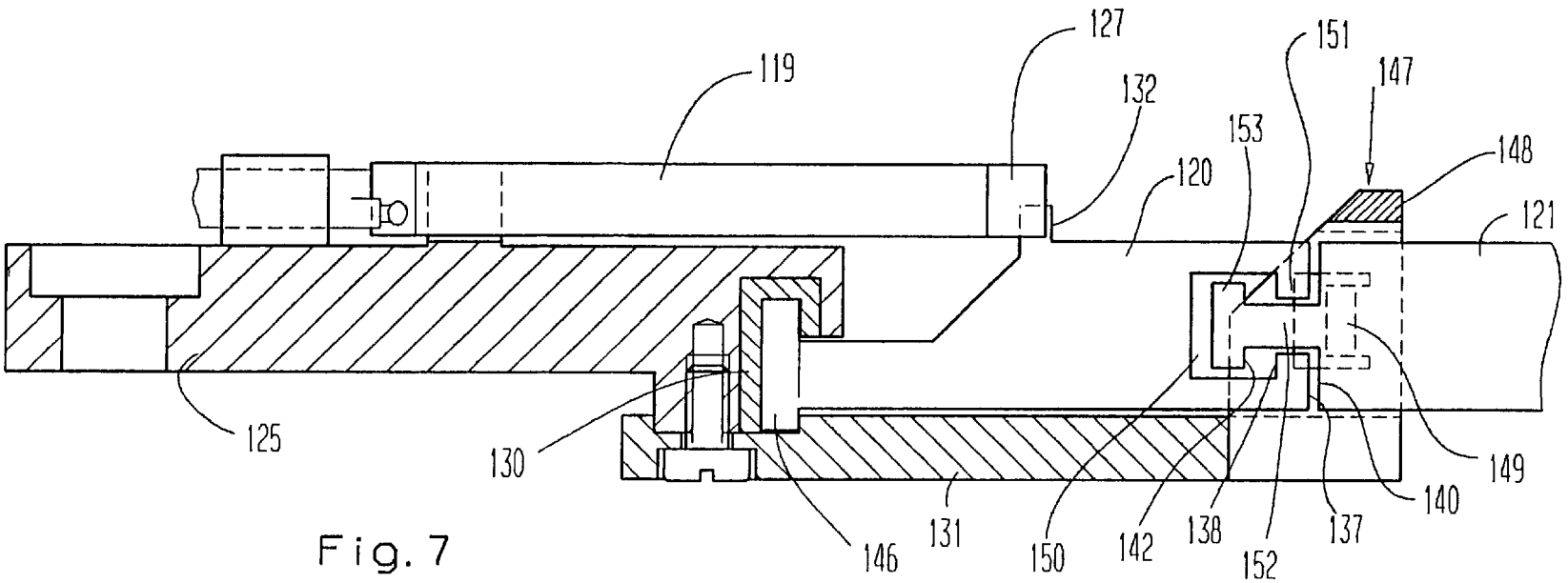
FIG. 7 is a partial cross-sectional, side elevational view of a second embodiment of a stroke control arrangement.
Figure 8:
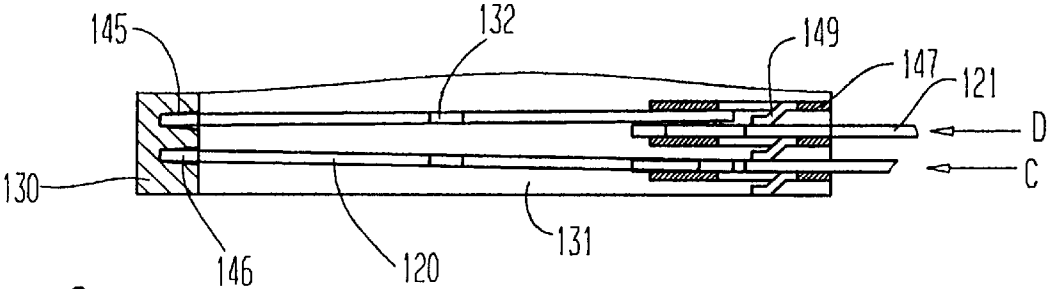
FIG. 8 is a partial cross-sectional, side elevational view of the entrainment means of FIG. 7.

In FIGS. 7 and 8 there are illustrated embodiments wherein the corresponding item numbers are raised by 100. The difference is that the group of transducers (119) are displaced rearwardly in the stroke direction relative to the entrainment means (120) thus, the displacement of the entrainment means (120) is approximately twice as large as that of the corresponding transducers (119).

Furthermore, a package of guide sheets (147) rest on lid (131) which, by means of ledge (148) are held in such separation that an entrainment means (120) and a stroke element (121) find adequate moving room between them. The guide walls (147) comprise inwardly bent guide lamellae (149) so that the stroke element (121) is guided from both sides.

On the free ends of entrainment means (120) there is an aperture (150) whereby there are provided a mutually opposing pair of flange segments (151). The stroke element (121) is provided with an extension (152) with mutually extending flange segments (153). There is thus provided on one face edge, an entrainment (137) which equally works with an edge-formed entrainment counterstop (140) on the face side of the stroke element (121) when both elements lie in the same plane (first position (C)). The consequence is that during the stroke movement of the carrier (16) the stroke element (121) is carried along by entrainment means (120). Furthermore, an edge of the flange segment (151) forms a return stop (138) and the edge on flange segment (153) forms a return counterstop (142), when the entrainment means finds itself in the first position C. Thus, stroke element (121) during the return movement of the carrier is brought back into the at rest position. Per contra, if the entrainment means (120) takes up the second position D during the stroke movement of the carrier (16) the appropriate stroke element (121) remains in its previous position.

In toto, there is obtained a reliably operating stroke control arrangement with a long life and, what is particularly important for warp knitting machines, a very small spacing between the individual stroke elements of two millimeters or less.

The suggested stroke control arrangement is suitable not only for the described purpose of clamping a thread. By utilizing this methodology guides can also be displaced. The system is utilizable for all stroke controls in which individual threads from a thread sheet are to be influenced in particular, with knitting machines.

Obviously, many modifications and variations of the present invention are possible in light of the above teachings. It is therefore to be understood that within the scope of the appended claims, the invention may be practiced otherwise than as specifically described.

We claim:

1. Stroke control arrangement for influencing individual threads of a thread sheet for a warp knitting machine, comprising:

a longitudinally extending bar;

a plurality of guided stroke elements each having a counterstop and each being mounted on said longitudinally extending bar in a stroke direction;

a carrier extending longitudinally and adapted to reciprocate in the stroke direction;

a plurality of piezoelectric transducers mounted in a row at said carrier, each of said transducers being responsive to an electrical control signal and each having a restrained and connected to the carrier, and a free end moveable, in dependence upon the electrical control signal, between a first position and a longitudinally displaced second position;

plurality of entrainment means transversely mounted adjacent to the transducers and each having one end with a stop and another end supported on a portion of said carrier, each of said entrainment means being coupled to the free end of a corresponding one of said transducers and being operable (a) in a first position to affect engagement between said stop of said entrainment means and said counterstop of the stroke element, in order to carry the corresponding one of said stroke elements in the stroke direction, and (b) in a second position to refrain from effecting the stroke elements.

2. Stroke control arrangement in accordance with claim 1, wherein the entrainment means each comprise:

a substantially flat metallic sheet.

3. Stroke control arrangement In accordance with claim 1, wherein the entrainment means comprise:

side arms connecting to the free ends of corresponding ones of the transducers.

4. Stroke control arrangement in accordance with claim 3, wherein the carrier has a plurality of tapered grooves adapted to support said entrainment means.

5. Stroke control arrangement In accordance with claim 3, wherein each of the transducers have a midsection, and at the free end comprise:

an end piece having a slot which has a thickness and breadth equivalent to an adjacent portion of the midsection of the transducer, the side arms of the entrainment means being held in the slots of the second pieces.

6. Stroke control arrangement in accordance with claim 3, wherein each of the entrainment means has a return stop and each of the stroke elements has a return counterstop, the entrainment means being operable to retract the stroke elements In the stroke direction upon contact of the return stops of the entrainment means against the return counterstops of the stroke elements.

7. Stroke control arrangement in accordance with claim 3, wherein each of the stroke elements has a return counterstop in addition to the counterstop, and wherein the entrainment means each have a distal edge, an aperture, and a section formed into a stop member between the distal edge and the aperture, the entrainment means in the first position being located substantially flat against the stroke elements with the stop member between sidewardly projection portions of the counterstop end the return counterstop.

8. Stroke control arrangement in accordance with claim 3, wherein each of the stroke elements has an extension forming the counterstop, the stops of entrainment means being operable to engage the counterstops of the extensions of the stroke elements in the first position of the entrainment means, the stops and the counterstops being formed by edges of the entrainment means and the stroke elements.

9. Stroke control arrangement In accordance with claim 3, comprising:

a plurality of guide walls supported by a portion of the carrier and interdigitated between the entrainment means and the stroke elements.

10. Stroke control arrangement in accordance with claim 3, wherein the carrier has a plurality of swing path limiting apertures, and wherein said side arms of the entrainment means comprise:

a plurality of protrusions held within the swing path limiting apertures.

11. Stroke control arrangement in accordance with claim 10, wherein the transducers and the entrainment means extend away from the stroke elements, the transducers extending away from the stroke elements further than said entrainment means.

12. Stroke control arrangement in accordance with claim 1, wherein the transducers and the entrainment means extend away from the stroke elements, the transducers extending away from the stroke elements further than said entrainment means.

13. Stroke control arrangement In accordance with claim 12, wherein the carrier has a plurality of tapered grooves adopted to support said entrainment means.

14. Stroke control arrangement in accordance with claim 12, wherein each of the entrainment means has a return stop and each of the stroke elements has a return counterstop, the entrainment means being operable to retract the stroke elements in the stroke direction upon contact of the return stops of the entrainment means against the return counterstops of the stroke elements.

15. Stroke control arrangement In accordance with claim 14, wherein each of the stroke elements has an extension forming the counterstop, the stops of entrainment means being operable to engage the counterstops of the extensions of the stroke elements in the first position of the entrainment means, the stops and the counterstops being formed by edges of the entrainment means and the stroke elements.

16. Stroke control arrangement in accordance with claim 12, wherein each of the stroke elements has a return counterstop in addition to the counterstop, and wherein the entrainment means each have a distal edge, an aperture, and a section formed into a stop member between the distal edge and the aperture, the entrainment means in the first position being located substantially flat against the stroke elements with the stop member between sidewardly projection portions of the counterstop and the return counterstop.

17. Stroke control arrangement In accordance with claim 12, comprising:

a plurality of guide walls supported by a portion of the carrier and interdigitated between the entrainment means and a stroke elements.

18. Stroke control arrangement in accordance with claim 12, comprises:

an axle for rotatably supporting the entrainment means at one end thereof.

19. Stroke control arrangement in accordance with claim 18 comprising:

a plurality of inserts mounted in said carrier and adapted to support said entrainment means, said inserts having a material with support qualities superior to the carrier.

20. Stroke control arrangement in accordance with claim 1, comprises:

an axle for rotatably supporting the entrainment means at one end thereof.

21. Stroke control arrangement in accordance with claim 20, comprising:

a plurality of inserts mounted in said carrier and adapted to support said entrainment means, said inserts having a material with support qualities superior to the carrier.

22. Stroke control arrangement in accordance with claim 1, wherein the carrier has a plurality of tapered grooves . adapted to support said entrainment means.

23. Stroke control arrangement in accordance with claim 1, comprising:

a plurality of inserts mounted in said carrier and adapted to support said entrainment means, said inserts having a material with support qualities superior to the carrier.

24. Stroke control arrangement in accordance with claim 1, wherein each of the entrainment means has a return stop and each of the stroke elements has a return counterstop, the entrainment means being operable to retract the stroke elements in the stroke direction upon contact of the return stops of the entrainment means against the return counterstops of the stroke elements.

25. Stroke control arrangement in accordance with claim 1, wherein each of the stroke elements has a return counterstop in addition to the counterstop, and wherein the entrainment means each have a distal edge, an aperture, and a section formed into a stop number between the distal edge and the aperture, the entrainment means in the first position being located substantially flat against the stroke elements with the stop member between sidewardly projection portions of the counterstop and the return counterstop.

26. Stroke control arrangement in accordance with claim 25, wherein for each of the stroke elements at least one of the counterstop and return counterstop are formed as a tongue pressed out of the stroke element.

27. Stroke control arrangement in accordance with claim 25, wherein at least one of the counterstops and return counterstops for each of the stroke elements comprises:

a plate placed on the stroke element.

28. Stroke control arrangement in accordance with claim 27, wherein the carrier has a guide groove, the plate lying over the stroke element transversely and being held In the guide groove.

29. Stroke control arrangement in accordance with claim 1, wherein each of the stroke elements has an extension forming the counterstop, the stops of entrainment means being operable to engage the counterstops of the extensions of the stroke elements in the first position of the entrainment means, the stops and the counterstops being formed by edges of the entrainment means and the stroke elements.

30. Stroke control arrangement in accordance with claim 29, wherein in the first position of the entrainment means the extensions of the stroke elements are held in an aperture of the entrainment means, the entrainment means each having and the stroke elements each having transversely extending segments that overlap.

31. Stroke control arrangement in accordance with claim 1, comprising:

a plurality of guide walls supported by a portion of the carrier and interdigitated between the entrainment means and a stroke elements.

32. Stroke control arrangement in accordance with claim 31, wherein the guide walls have a plurality of guide lamellae, the stroke elements being located between a corresponding one of the guide lamella on a corresponding one of the guide walls and an adjacent one of the guide walls.

* * * * *